United States Patent [19]

Cheung

[11] Patent Number: 4,962,733

[45] Date of Patent: Oct. 16, 1990

[54] DEVICE FOR REDUCING THERMAL RESTRAINT

[75] Inventor: Chi-Chung P. Cheung, Peoria, Ill.

[73] Assignee: Caterpillar Inc., Peoria, Ill.

[21] Appl. No.: 414,845

[22] Filed: Sep. 29, 1989

[51] Int. Cl.[5] ..... F02F 1/42

[52] U.S. Cl. ..... 123/193 H; 123/188 M

[58] Field of Search ..... 123/315, 193 H, 193 CH, 123/41.82, 188 M

[56] References Cited

U.S. PATENT DOCUMENTS

| | | | |
|---|---|---|---|
| 2,791,989 | 5/1957 | Dickson . | |
| 2,893,371 | 7/1959 | Schafer, Jr. . | |
| 3,117,565 | 1/1964 | Bottger et al. | 123/41.57 |
| 3,865,087 | 2/1975 | Sihon | 123/188 M |
| 3,903,849 | 9/1975 | List et al. | 123/188 M |
| 4,337,735 | 7/1982 | Lichtner et al. | 123/193 H |
| 4,426,963 | 1/1984 | Lichtner | 123/193 H |
| 4,433,653 | 2/1984 | Lichtner et al. | 123/193 H |
| 4,844,030 | 7/1989 | McAvoy | 123/193 H |

*Primary Examiner*—Andrew M. Dolinar
*Assistant Examiner*—M. Macy
*Attorney, Agent, or Firm*—Larry G. Cain

[57] ABSTRACT

Thermal restraints associated with internal combustion engines create complex problems which must be overcome in order to provide life and durability of the engine. The present device overcomes these problems by providing a pair of notches positioned in a bridge connection at least two housings. The housings have a predetermined stiffness and the bridge has a predetermined stiffness less than that of the housings. The pair of notches extend between the housings. The thermal relief provided by the pair of notches introduces concentration factors to the low stiffness area. As a result the low stiffness area is able to expand and reduce the thermal compressive stress.

15 Claims, 3 Drawing Sheets

DEVICE FOR REDUCING THERMAL RESTRAINT

DESCRIPTION

1. Technical Field

This invention relates generally to engine cylinder heads, and more particularly to an improved cylinder head to resist local thermal restraint and prevent bottom deck cracking.

2. Background Art

In a convention engine, local thermal restraint exists and some degree of bottom deck cracking normally occurs. Attempts have been made to eliminate cracking, some have been relatively successful and others have failed badly. In today's high compression engines, the bottom deck must be constructed to withstand high combustion pressure and thermal loading. A standard analytical method used to predict the thermal fatigue life of such components is the Smith-Watson-Topper method. In this method, a finite element model of the head and block is constructed. The model is usually made up of linear solid brick and wedge elements. Models of the block and head are connected together using gap elements and scalar spring elements on all other load cases. Bar elements are used to simulate the head bolts for all loading conditions. The boundary conditions and loads are established from experimental data and stress and strain magnitude at the critical area in the bottom deck are calculated.

In some applications of cylinder heads used with todays engines, it has been found that bottom deck cracking of the bridge between the housings extending about a valve passage for the intake valves and the housing extending about a unit injector is caused by thermal restraint. U.S. Pat. No. 4,844,030 issued to Paul C. McAvoy on Jul. 4, 1989 discloses such a notch in FIG. 1. The patent goes on to disclose a circular cut-out portion radially spaced from and injector bore in nonintersecting relationship and located between the injector bore and the center lines of the valve openings.

Another example of a device to reduce thermal restraint is disclosed in U.S. Pat. No. 4,426,963 issued to Emil Lichtner on Jan. 24, 1984, U.S. Pat. No. 4,337,735 issued to Emil Lichtner, Gerd Ungeringer and Gerhard Giebel on Jul. 6, 1982 and U.S. Pat. No. 4,433,653 issued to Emil Lichtner, Gerd Ungeringer and Gerhard Giebel on Feb. 28 1984. The specification of each patent discloses that the bottom region includes grooves or joints extending in a slightly curved or arcuate manner from valve opening to valve opening. The joints are filled with plates or inserts.

In another example, U.S. Pat. No. 2,791,989 issued to John Dickson on May 14, 1957 discloses an annular groove adjacent the side walls of the cylinder and a plurality of angularly spaced grooves formed radially inwardly of the annular groove.

The problem solved by the present application overcomes the cracking caused by thermal restraint in the bridge or weakest link between two rigid bodies, the housing about the intake valve passage and the housing extending about the unit injector. The housings are much stiffer than the bridge and, therefore, thermal strains cause the material in the bridge area, between the housings, to expand and crack. In past applications a single notch in the bridge, but not directly in the bridge portion of the cracking area, has significantly increased the fatigue life and reduced the thermal restraint of the bridge. It has been found that in a structure where the cracking occurs in the middle or relatively close to the middle, between two housings, a single flycut does not solve the problem and prevent cracking. In fact, when the crack is located in the middle between the housing a single cut in the bridge between the housings will increases the stress level rather than reduce the stress level. It has been theorized and shown analytically that the greater the depth of the flycut of a single notch the greater the localized strain is relieved; however, it has also been determined that the depth of a single notch has a direct relationship to the strength of the bridge. Thus, the depth of the notch and the degree that strain is relieved is limited.

The present invention is directed to overcome one or more of the problems as set forth above.

DISCLOSURE OF THE INVENTION

In one aspect of the present invention, a device for reducing thermal restraint is disclosed. The device is comprised of a plurality of housings being substantially fixedly positioned a predetermined distance apart and having a predetermined stiffness. A bridge connects at least two of the housings and has a stiffness less than the predetermined stiffness of the housings and at least a pair of notches are positioned in the bridge and extending between the housings.

In another aspect of the present invention, a cylinder head has a bottom deck portion including a plurality of openings therein, each of the openings being spaced from each other and each having a housing therearound extending from the bottom deck. The deck further includes a bridge connecting at least two of the housings and the improvement comprises; the housings having a predetermined stiffness, the bridge having a predetermined stiffness less than the predetermined stiffness of the housings and at least a pair of notches positioned in the bridge and extending between the housings.

The present invention provides a device for reducing thermal restraint in a bridge between at least two housings which are stiffer than the bridge itself. The pair of notches reduces localized strain and allows the bridge to expand relatively at a greater rate and prevents cracking.

BEST MODE FOR CARRYING OUT THE INVENTION

Figure 1:
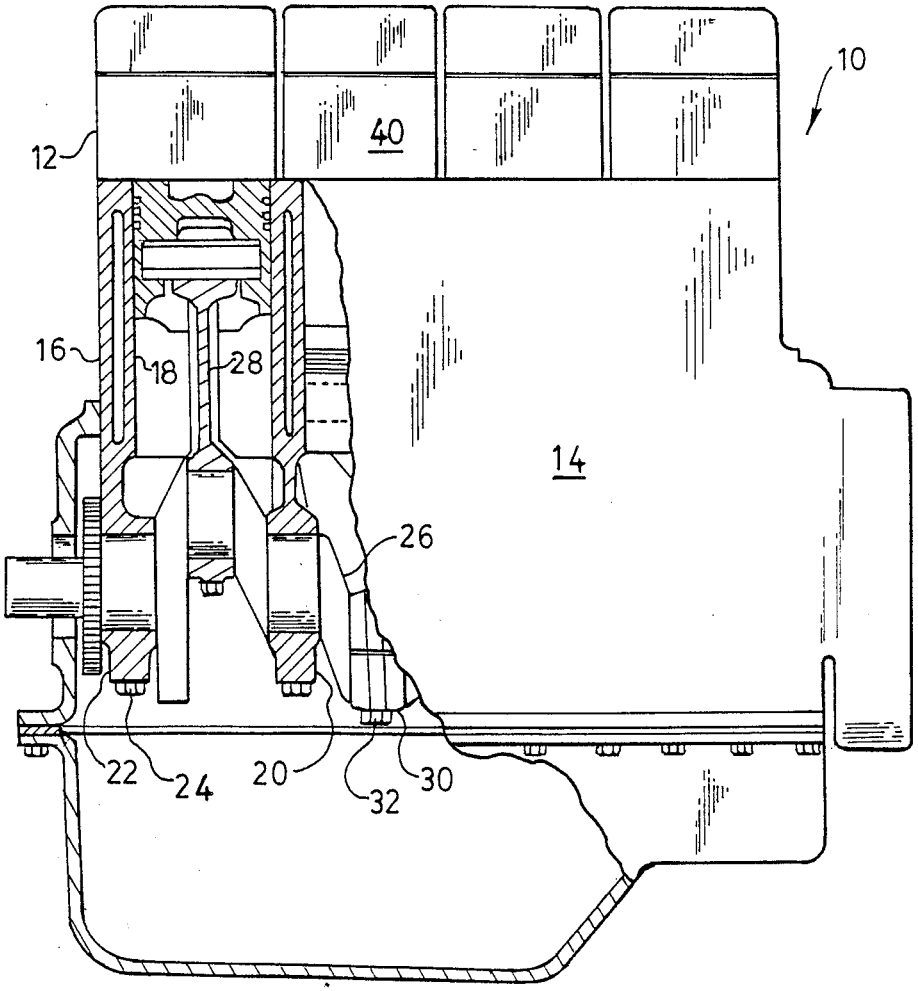
FIG. 1 is a side view of an engine embodying the present invention with portions shown in section for illustrating convenience.
Figure 2:
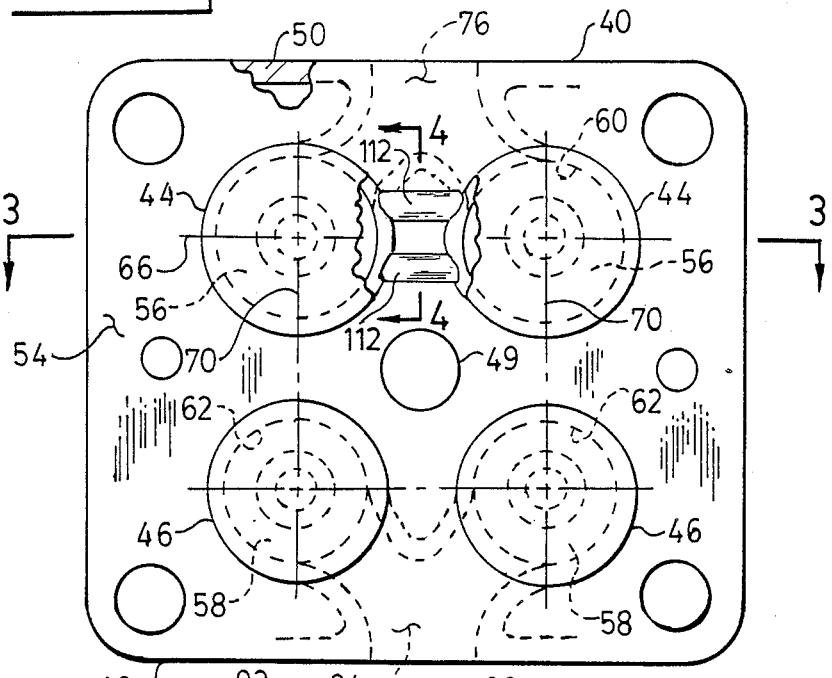
FIG. 2 is a bottom view of one of the cylinder heads embodying the present invention.

Referring to FIGS. 1 and 2, a device 10 is adapted for use in a cylinder head 12 of an internal combustion engine 14. The engine 14 includes a cylinder block 16 having a plurality of cylinder bores 18 therein, a crankshaft mounting means 20 which include a plurality of main bearing caps 22 removably attached to the cylinder block 16 by a plurality of bolts 24. A crankshaft 26 is rotatably connected to the cylinder block 16 by the plurality of main bearing caps 22. A plurality of piston and connecting rod assemblies 28 and a plurality of connecting rod bearing caps 30 are removably attach to the crankshaft 26 by a plurality of bolts 32. The cylinder head 12 further includes a plurality of individual cylinder head assemblies 40. As an alternative the engine could include a single cylinder head.

Figure 3:
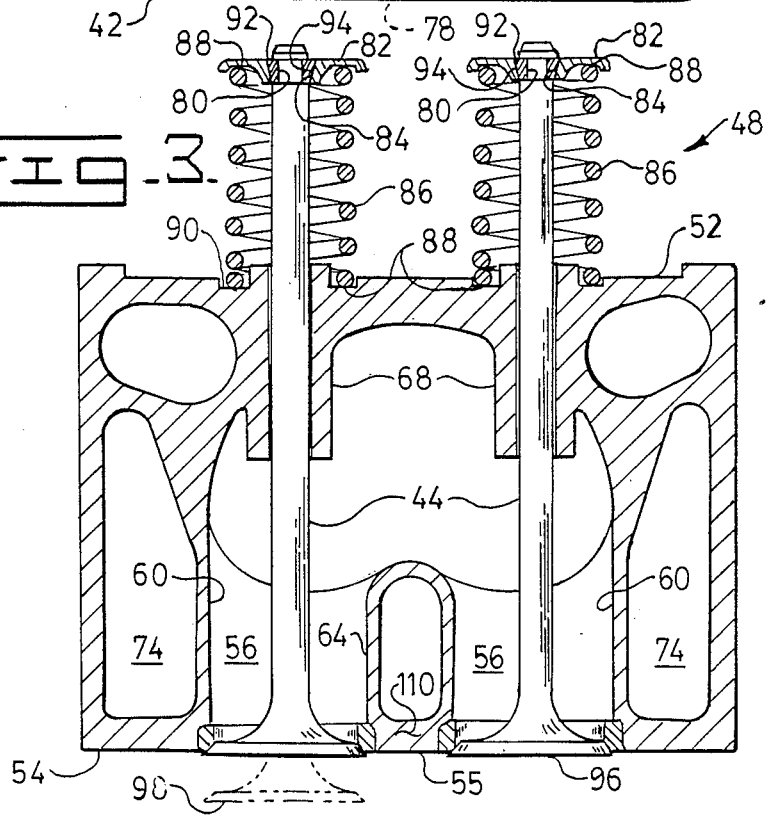
FIG. 3 is a cross-sectional view taken along line 3—3 of FIG. 2.

As best shown in FIGS. 2 and 3, each cylinder head assembly 40 includes a cast body 42, a pair of intake valves 44, a pair of exhaust valves 46, a plurality of return means 48 and a unit injector passage and housing therearound 49. The cast body 42 has a generally rectangular structure outer shell 50, a top deck portion 52 and a bottom deck portion 54 having a bottom deck surface 55. The cast body 42 further includes a pair of intake passages 56 and a pair of exhaust passages 58, a pair of housings 60 extends about the intake passages 56 and a pair of housings 62 extends about the exhaust passages 58, each of the housings 60,62 have a center 64 and a plane 66 extending therethrough the centers 64. The housings 60,62 are substantially fixedly positioned a predetermined distance apart and extend from the bottom deck portion 54. In this specific application, the distance between the centers 64 of the housing 60,62 is approximately 55 mm. Each of the housings 60,62 also have a predetermined stiffness. The body 42 further includes a plurality of valve guide portions 68, each having a center 70, which are fixedly attached to the top deck portion 52. In this particular application, the centers 64 of the housings 60,62 and the centers 70 of the valve guide portions 68 are axially aligned. The plane 66 passes horizontally through the centers 64,70. The cast body 42 further includes a plurality of interconnected cooling passages 74, an intake port 76 and an exhaust port 78.

Each return means 48 includes a groove 80 in each of the valves 44,46, a retainer 82 having a tapered bore 84 therein, a spring 86 having a pair of flattened ends 88 and being positioned about each valve 44,46. One of the ends 88 of the spring 86 is in contact with a seat portion 90 of the top deck portion 52 and the other end 88 is in contact with the retainer 82. A pair of keepers 92 having a wedged shaped outer surface 94 is positioned in the groove 80 and in locking relationship with the tapered bore 84. Thus, the retainer 82 places the spring 86 in a compressive state between the retainer 82 and the top deck portion 52 and holds the valves 44,46 in a closed position 96.

The valves 44,46 and the return means 48 are actuated into an open position 98, shown in phantom, in a conventional manner by a cam, lifter, pushrod and rocker arm combination, not shown.

Figure 4:
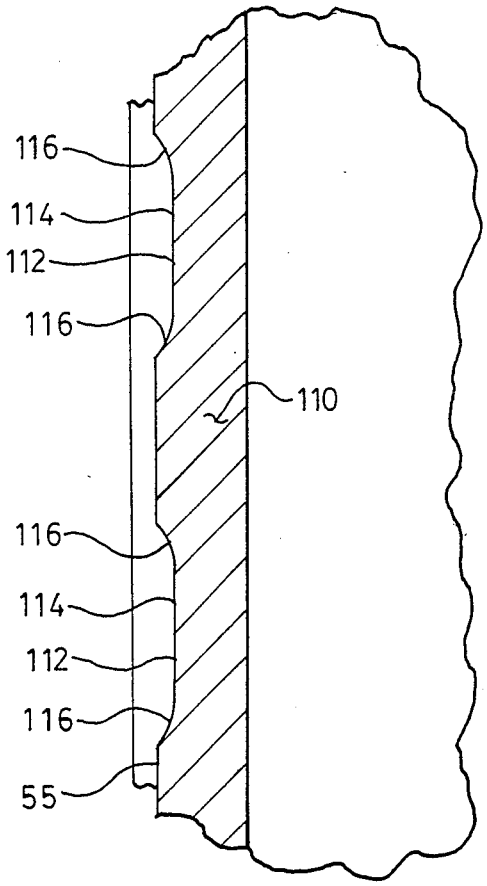
FIG. 4 is an enlarged partial cross-sectional view taken along line 4—4 of FIG. 2.

As best shown in FIGS. 2 and 4, the bottom deck portion 54 of the body 42 further includes a bridge 110 having a predetermined thickness, which in this specific application is equal to approximately 12 mm, and is connected to at least two of the housings 60,62. The bridge 110 further has a predetermined stiffness less than the predetermined stiffness of the housings 60,62. A pair of notches 112 positioned in the bridge 110, extend between the housings 60,62 and have a predetermined depth. In this particular application, each of the notches 112 is positioned in the bottom deck surface 55 side of the bridge 110 and has a depth which is equal. Although somewhat difficult to attain, as an alternative, the pair of notches 112 could be positioned in the side opposite the bottom deck surface 55. The depth in this application has a value of approximately 1.5 mm. In general, the depth of the notches 112 should fall in a range of from about 0.1 to 0.2 times the thickness of the bridge 110. It has been theorized that the above range provides the maximum amount of local strain relief and reduces the local thermal stress to its maximum without jeopardizing the structural integrity of the cylinder head assembly 40. The notches 112 further have a flat portion 114 positioned below the bottom deck surface 55 and a pair of blending radius portions 116 positioned at each end of the flat portion 114 extending from the flat portion 114 to the bottom deck surface 55. As an alternative the notches 112 could be of an arcuate or another generally smooth configuration. The notches 112 are substantially equally spaced from the plane 66. It is theorized that the pair of notches 112 should be centered about the crack, which in this application corresponds to the plane 66. It is further theorized that there is an interrelationship between the relative distance between the housings 60,62, the thickness of the bridge 110 and the depth of the pair of notches 112. For example, if the thickness of the bridge 110 remains constant and the distance between the housings 60,62 is increased the distance between the pair of notches and the relative center distance from the plane 66 should increase a directly proportionate amount. With the above conditions, the depth of the pair of notches 112 can be reduced. It is further speculated that if the distance between the housings in increased, the thickness of the bridge is increased then the depth of the pair of notches 112 should remain the same depth. Thus, the range as established above will provide an appropriate depth of the pair of notches 112 relative to the distance between the housings 60,62 and the bridge thickness to provide local strain relief and reduce local thermal stress.

Industrial Applicability

The device 10 is used to reduce thermal restraint in the cylinder head 12 of an engine 14. The internal combustion engine 14 is started, combustion takes place in the engine 14 and heat is produced. The heat is dissipated into the cooling passages 74, converted into mechanical energy to drive the piston and connecting rod assemblies 28 rotating the crankshaft 26 and is absorbed into the components of the engine such as the block 16 and the cylinder head assembly 40. The heat induced and absorbed by the components varies and the expansion rate of the components vary. For example, the composition of the components and the stiffness of the components varies the thermal rate of expansion.

During early development of a new prototype engine, several problems occurred. Endurance test failures of the cylinder head assembly 40 occurred and cracking of the cylinder head assembly 40 bottom deck portion 54 was observed. An investigation was conducted to determine the reason or reasons for the problems. The problems were defined as being caused by thermal compressive stress. The housings 60,62 are much stiffer than the bridge 112 and, therefore, cracking occurs due to thermal compressive stress. To overcome the problem, several alternatives were recommended and tried. For example, the material composition was changed to provide a stronger material, the thickness of the bottom deck portion 54 including the thickness of the bridge 110 area between the intake valve housings 60 in which the cracks occurred was made thinner in an attempt to reduce the stiffness of the bridge 110 and allow the bridge 110 to expand more easily. The material change solved the endurance test failure but did little to solve the bottom deck portion 54 cracking problem. The thickness reduction reduced the cracking problem but did not eliminate the problem to an extent that the problem could be tolerated. In a further attempt to eliminate the problem a double flycut or a pair of notches 112 was added to the bottom deck portion 54 in the bridge 110 area. The pair of notches 112 reduced the stiffness and allowed the bridge 110 area to flex without cracking and solved the problem.

Thermal restraint relief provided by the double notch flycut of pair of notches 112 can be explained or visualized as introducing two notch concentration factors to the low stiffness area. The pair of notches 112 relieve the low stiffness area by reducing the stiffness of the adjacent area. As a result, the low stiffness area is able to expand and reduce the thermal compressive stress.

Other aspects, object and advantages of this invention can be obtained from a study of the drawings, the disclosure and the appended claims.

I claim:

1. An engine cylinder head having a deck, said deck having a high temperature fluid acting on at least a portion thereof subjecting said portion of the deck to a thermal load causing thermal expansion of said portion of the deck, said engine cylinder head including a plurality of passages therein extending from said deck, each of said passages being spaced from each other and each having a housing therearound, said deck further including a bridge connecting at least two of the housings: the improvement comprising;

said housings having a predetermined stiffness;

said bridge having a predetermined stiffness less than the predetermined stiffness of the housings; and a device for reducing thermal restraint including at least a pair of notches positioned in the bridge and extending between the housings.

2. The engine cylinder head of claim 1 wherein each of said plurality of housings have a center and a plane through each of the centers, and each notch of the pair of notches is substantially equally spaced from the plane.

3. The engine cylinder head of claim 1 wherein each notch of said pair of notches has a predetermined depth.

4. The engine cylinder head of claim 3 wherein said predetermined depth of the notches are equal.

5. The engine cylinder head of claim 4 wherein each of said pair of notches includes a flat portion and a pair of radius portions.

6. The engine cylinder head of claim 1 wherein said bridge has a predetermined thickness.

7. The engine cylinder head of claim 6 wherein said predetermined depth includes a range of from about 0.1 to 0.2 times the thickness of the bridge.

8. An engine cylinder head having a bottom deck portion having a bottom deck surface, said cylinder head including a plurality of passages therein, each of said passages being spaced from each other and each having a housing therearound extending from the bottom deck portion, said bottom deck portion further including a bridge connecting at least two of the housings: the improvement comprising;

said housings having a predetermined stiffness;

said bridge having a predetermined stiffness less than the predetermined stiffness of the housings; and at least a pair of notches positioned in the bridge and extending between the housings.

9. The engine cylinder head of claim 8 wherein each of said pair of notches is positioned in the bottom deck surface.

10. The engine cylinder head of claim 8 wherein each of said plurality of housings has a center and a plane through each of the centers, and each notch of the pair of notches is substantially equally spaced from the plane.

11. The engine cylinder head of claim 8 wherein each notch of said pair of notches has a predetermined depth.

12. The engine cylinder head of claim 11 wherein said predetermined depth of the pair of notches are equal.

13. The engine cylinder head of claim 12 wherein each of said pair of notches includes a flat portion and a pair of radius portions extending from the flat portion to the bottom deck surface.

14. The engine cylinder head of claim 8 wherein said bridge has a predetermined thickness.

15. The engine cylinder head of claim 13 wherein said predetermined depth includes a range of from about 0.1 to 0.2 times the thickness of the bridge.

* * * * *